US006568680B1

(12) United States Patent
Moody et al.

(10) Patent No.: US 6,568,680 B1
(45) **Date of Patent: *May 27, 2003**

(54) ELECTRONIC VIDEO POKER GAMES

(76) Inventors: Ernest W. Moody, 2116 Redbird Dr., Las Vegas, NV (US) 89134; Michael W. Wood, 1106 Willowbrook Ave., Denham Springs, LA (US) 70726

( * ) Notice: Subject to any disclaimer, the term of this patent is extended or adjusted under 35 U.S.C. 154(b) by 0 days.

This patent is subject to a terminal disclaimer.

(21) Appl. No.: 09/698,892

(22) Filed: Oct. 26, 2000

Related U.S. Application Data

(63) Continuation-in-part of application No. 09/633,479, filed on Aug. 7, 2000, and a continuation-in-part of application No. 09/175,226, filed on Oct. 20, 1998, now Pat. No. 6,098,985, and a continuation-in-part of application No. 09/083,531, filed on May 22, 1998, now Pat. No. 6,007,066, and a continuation-in-part of application No. 08/900,965, filed on Jul. 25, 1997, now Pat. No. 5,823,873, and a continuation-in-part of application No. 08/755,174, filed on Nov. 25, 1996, now Pat. No. 5,732,950, which is a continuation-in-part of application No. 08/495,952, filed on Jun. 28, 1995, now Pat. No. 5,531,448.

(60) Provisional application No. 60/019,879, filed on Jun. 17, 1996.

(51) Int. Cl.[7] ..... A63F 1/00; A63F 13/00

(52) U.S. Cl. ..... 273/292; 463/13

(58) Field of Search ..... 273/292, 274, 273/309; 463/13, 12

(56) References Cited

U.S. PATENT DOCUMENTS 5,042,818 A * 8/1991 Weingardt ..... 273/292
5,356,140 A * 10/1994 Dabrowski et al. ..... 273/292
5,816,915 A * 10/1998 Kadlic ..... 463/13
5,823,873 A * 10/1998 Moody ..... 463/13
6,045,129 A * 4/2000 Cooper et al. ..... 463/13
6,176,781 B1 * 1/2001 Walker et al. ..... 463/13
6,334,613 B1 * 1/2002 Yoseloff ..... 273/292

* cited by examiner

*Primary Examiner*—Benjamin H. Layno
(74) *Attorney, Agent, or Firm*—John Edward Roethel

(57) ABSTRACT

A card game is described in which a player makes a total wager prior to the initial starting hand being dealt. One hand of five cards is displayed to the player with all of the initial cards being dealt face up. The player then determines how many times the player wishes to play the initial starting hand and the total wager is divided into multiple parts, each part being allocated to a different play of the initial starting hand. The player then plays the starting hand for a FIRST PLAY and the player then selects none, one or more of the face up cards as cards to be held. Replacement cards for the non-selected cards are dealt into the hand and the poker hand ranking of the FIRST PLAY is determined. The initial deal of the starting cards is then re-used and becomes a SECOND PLAY. The player again selects none, one or more of the face up cards as cards to be held. Replacement cards for the non-selected cards are dealt and the poker hand ranking of the SECOND PLAY is determined. These steps are repeated until the player has completed play of all of the plays that the player chose at the beginning of the round of the game. The player is paid for any winning poker hands based on a pay table and the amount of the player's wager on each play.

10 Claims, 5 Drawing Sheets

ELECTRONIC VIDEO POKER GAMES

CROSS-REFERENCE TO RELATED APPLICATIONS

This application is a Continuation-in-Part of application Ser. No. 08/495,952, entitled "Poker-Style Card Game", filed Jun. 28, 1995, now U.S. Pat. No. 5,531,448; and is also based on and is a Continuation-in-Part of Provisional Application Ser. No. 60/019,879, entitled "Electronic Video Poker Games", filed Jun. 17, 1996; and is also a Continuation-in-Part of application Ser. No. 08/755,174, entitled "Electronic Video Poker Games", filed Nov. 25, 1996, now U.S. Pat. No. 5,732,950; and is also a Continuation-in-Part of application Ser. No. 08/900,965, entitled "Electronic Video Poker Games", filed Jul. 25, 1997, now U.S. Pat. No. 5,823,873; and is also a Continuation-in-Part of application Ser. No. 09/083,531, entitled "Electronic Video Poker Games", filed May 22, 1998, now U.S. Pat. No. 6,007,066; and is also a Continuation-in-Part of application Ser. No. 09/175,226, entitled "Electronic Video Poker Games", filed Oct. 20, 1998, now U.S. Pat. No. 6,098,985; and is also a Continuation-in-Part of application Ser. No. 09/633,479, entitled "Electronic Video Slot and Poker Games", filed Aug. 7, 2000, now pending. The disclosure of each of these earlier patents and/or applications is incorporated herein by this reference, with each of these earlier applications being commonly owned with this application.

BACKGROUND OF THE INVENTION

This invention relates primarily to electronic video poker games, and more particularly to electronic video poker games that are based on poker hand rankings and that allow the player to discard and replace unwanted cards with replacement cards. The present invention has many versions with the common thread being that cards from an initial hand of cards are re-used in one or more subsequent or additional hands to allow the player the opportunity to play one or more cards from the starting hand of cards multiple times.

SUMMARY OF THE INVENTION

The method of the present invention involves a card game in which the player can play the initial starting hand of cards one or more times. The player makes a total wager prior to the initial starting hand being dealt. One hand of five cards is displayed to the player with all of the initial cards being dealt face up. The player then determines how many times the player wishes to play the initial starting hand. The player makes this determination by selecting the number of plays that the player wishes to have occur and the player's total wager is then divided into multiple parts, each part of which is allocated to a different play of the initial starting hand.

The player then plays the starting hand for the first time. The player then selects none, one or more of the face up cards from the first hand as cards to be held. Replacement cards for the non-selected cards are dealt and the poker hand ranking of the FIRST PLAY is determined.

The initial deal of the starting cards is then re-used and becomes a SECOND PLAY. The player again selects none, one or more of the face up cards from the second hand as cards to be held. Replacement cards for the non-selected cards are to dealt and the poker hand ranking of the SECOND PLAY is determined.

These steps are repeated until the player has completed play of all of the hands that the player chose to play based on the selection made by the player and how the total wager was divided. The player is paid for any winning poker hands based on a pay table and the amount of the player's wager on each play of the initial starting hand.

Alternatively, the method of the present invention can also be applied to three card poker or four card poker.

DETAILED DESCRIPTION OF THE PREFERRED EMBODIMENTS

Figure 1:
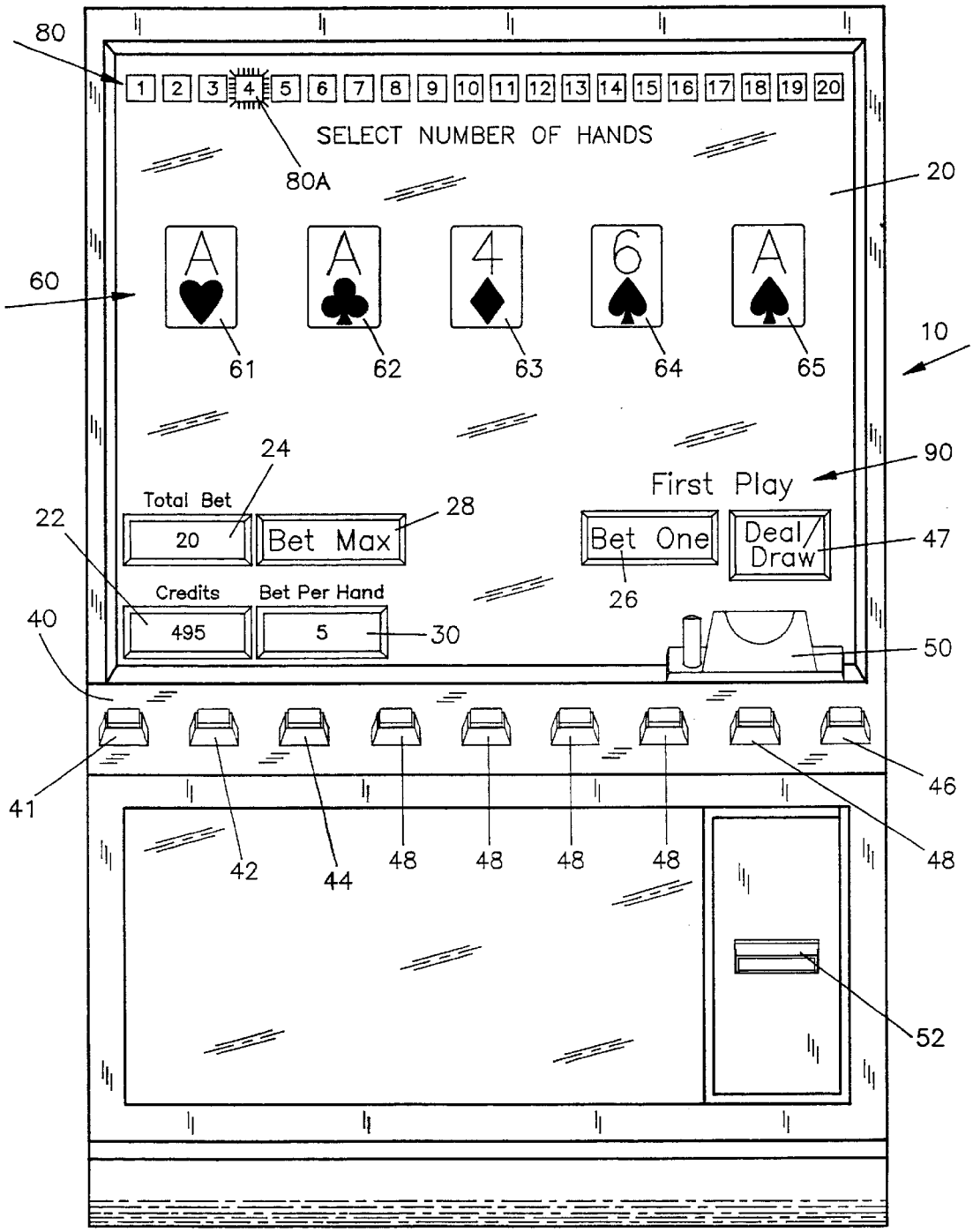
FIG. 1 shows a gaming machine that can be used to practice the method of the present invention including a screen display of the initial starting hand of Version #A of the present invention.

The present invention includes a variety of electronic video poker game formats each having multiple hands in which the initial deal of cards is replayed by the player a multiple number of times. Each electronic video poker game is designed to be played by having the hands displayed on a video screen to a player. The player makes a wager that is to be allocated or split by the player among one or more hands as determined by the player, but only after the player has seen the initial deal of cards.

The player makes a wager to be eligible to participate in the play of the game. A deck of cards is electronically shuffled and an initial five card hand is selected randomly and displayed to the player, all cards of the starting hand being displayed face up. The player looks at the starting hand of five cards and decides how many times the player wishes to play this starting hand. By manipulating buttons on the button panel of the gaming device or by using conventional touch screen technology, the player splits his initial wager among the number of plays of the starting hand that the player has decided to play.

Again by using the buttons on a button panel or by touching specified locations on the touch screen display, the player makes his FIRST PLAY by playing the first hand of the starting cards. The player selects which cards he wishes to hold and, thus, which cards he wishes to discard. The player activates a draw button and replacement cards are then displayed for the discarded cards forming the first five card hand. This FIRST PLAY final five card hand is analyzed for poker hand ranking and the outcome of the play of the hand is determined. An award is paid to the player for winning hand combinations based on the poker hand ranking achieved and the portion of the player's wager that has been allocated to the first hand. If the FIRST PLAY does not result in a winning combination, then the amount of the player's wager allocated to the FIRST PLAY is lost.

The initial five cards are then redisplayed on the video screen display and the player makes his SECOND PLAY by again holding the cards he wishes to keep, if any, which can be the same cards or different cards than were held during the FIRST PLAY of the hand. Replacement cards are again dealt and a final five card is displayed. This resulting SECOND PLAY final five card hand is analyzed for poker hand ranking and the outcome of the play of the hand is determined. An award is paid to the player for winning hand combinations based on the poker hand ranking achieved and the portion of the player's wager that has been allocated to this second hand. If the SECOND PLAY does not result in a winning combination, then the amount of the player's wager allocated to the SECOND PLAY is lost.

The redisplay of the initial five card hand, the draw step and the resulting five card hand are played over until all of the hands wagered on by the player have been played out, based on how the player split his wager at the beginning of the round of play.

The player wins awards or loses his wagers based on the poker hand rankings of the completed hands and the amount wagered by the player on each hand using a pay table that is displayed to the player.

FIG. 1 shows a gaming machine upon which the method of the present invention can be carried out. The gaming machine 10. includes a video screen display 20 on which are shown the playing cards that will be used during the play of the method of the present invention. The video screen display 20 also includes other information and data presented to the player to allow the player to understand the play of the game and to effect the operation of the method.

In the preferred embodiment of the present invention, the video screen display shows a credit meter 22, a display of the total number of credits 24 wagered for a particular round of play of the game and a display of the number of credits bet per hand 30. The video screen display also has a DEAL/DRAW touch screen location 47 to allow the player to effect the display of the initial deal of the cards and to effect the display of replacement cards. Other touch screen locations are also provided to allow the player to effect his wager which can be made one credit at a time using the BET ONE location 26 or which can be made by wagering the maximum number of credits allowed by the gaming machine using the BET MAX location 28.

Each of the card locations on the video screen display can also be touch screen locations that the player may designate which cards he wishes to, hold by merely touching the card location on the video screen display 20.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allow the player to wager either the maximum amount of credits or to wager one credit at a time on the play of the game as desired by the player. A DEAL/DRAW button 46 is provided to allow the player to effect the deal step or the draw step of the method of play as desired should the player prefer to use the button panel instead of the DEAL/DRAW touch screen location 47 on the video screen display 20. A plurality of HOLD buttons 48 are also provided to allow the player to select which cards the player wishes to hold should the player prefer to use the button panel instead of the card touch screen locations on the video screen display 20.

In the preferred embodiment of the present invention, when the initial five card hand is displayed on the video screen display 20, the player must choose which cards to hold by either pressing the card location on the touch screen or by pressing the HOLD button associated with the card position. Alternatively, it is possible to provide what is known as an "Auto-hold" feature to the method of play. When an "Auto-hold" is in use, the computer controls of the gaming machine analyze the initially displayed hand and suggest a HOLD to those cards that would give the player the best mathematical probability for that initial hand based on the pay table that is being used. The player can accept the suggested "Auto-hold" by pressing the DRAW location 47 or the DRAW button 46 and the draw step will take place. If the player declines the suggested "Auto-hold", the player must unhold any cards that were held by the "Auto-hold" if the player wishes to discard those cards and the player must manually hold any other cards that the player wishes to hold. The use of an "Auto-hold" feature speeds up play by increasing the number of hands per hour that can be played on the gaming machine.

The gaming machine 10 also includes a coin head 50 to allow the player to insert coins or gaming tokens as wagers to allow play of the gaming machine 10. A bill acceptor slot 52 is also provided on the gaming machine 10. In order to accrue credits that may be used to play the gaming machine 10, the player inserts paper currency or other suitable script or gaming coupons into the bill acceptor slot 52 behind which, on the interior of the gaming machine, is mounted a bill acceptor which takes in and validates the currency. The monetary value of the inserted currency is then applied to the credit meter 22, the credits on which the player may use to play the gaming machine.

Any other conventional and suitable equipment can be included in the gaming machine.

Version #A: The method of play of a preferred embodiment of the present invention will now be described.

At the beginning of a round of play, the player makes a wager of a multiple number of credits, for example, twenty credits. The player makes this wager by manipulating the BET MAX button 42 or the BET ONE button 44.

After the player has made his wager, the player presses the DEAL/DRAW button 46 to activate the computer controls of the gaming machine to display an initial five card hand on the video screen display 20. For example, as shown in FIG. 1, the player could receive as his initial cards: the Ace of Hearts 61, the Ace of Clubs 62, the Four of Diamonds 63, the Six of Hearts 64 and the Ace of Spades 65. The player has an initial starting hand with a poker hand ranking of Three-of-a-Kind.

The player now must decide how many times the player wishes to play this initial five card hand. The player makes this determination by splitting his initial total bet, in this case twenty credits, among a plurality of hands or by leaving the initial total bet all allocated to a single hand. It is simply a judgment call on the part of the player whether he wishes to risk all of his initial twenty credit bet on one chance to improve his initial Three-of-a-Kind, or whether the player wishes to spread the risk of improving his initial starting hand of Three-of-a-Kind over multiple chances. That is why it is called "gambling."

In the example shown in FIG. 1, the player could split his initial wager among between one and twenty plays of the initial starting hand 60. In one embodiment of the present invention, a series of touch screen locations 70 are provided on the video screen display 20 and these touch screen locations 80 are numbered from one to twenty. Each touch screen location 80 represents the number of times the player will play the initial starting hand 60. For example, if the player touches the screen location 80A which contains the number four, the player will play the initial starting hand four times.

The amount of the player's total wager will be allocated among the four plays of the initial starting hand that the player has selected. This allocation can be done in any suitable manner. For example, as shown in FIG. 1, if the player selects four as the number of plays of the initial starting hand 60, the total wager can be allocated as five credits on each of the four plays of the initial starting hand. This is shown in the Bet Per Hand meter 30 on the video display screen 20.

Alternatively, the gaming machine 10 can be configured so that the player selects how the initial total wager is to allocated among the several hands to be played. For example, another touch screen location or a button on the button panel can be provided so that the player can select how much to wager on each of the several hands. A player could chose to wager ten credits on the FIRST PLAY and then two credits each on the SECOND PLAY through the SIXTH PLAY. Of the player could chose to wager three credits on each of the first six plays with the remainder of two credits being allocated to the SEVENTH PLAY. Any of a variety of possible wagering allocation scenarios can be implemented depending on variety of choices that the gaming machine manufacturer wishes to offer to the player.

The player now plays out the initial starting hand for the FIRST PLAY of the hand. In a preferred embodiment of the present invention, indicia indicating the FIRST PLAY 90 can be displayed on the video screen display at a suitable location. The player then selects which of these initial five cards the player wishes to hold. The player may select none, any or all of the initial five cards as cards to be held.

Figure 2:
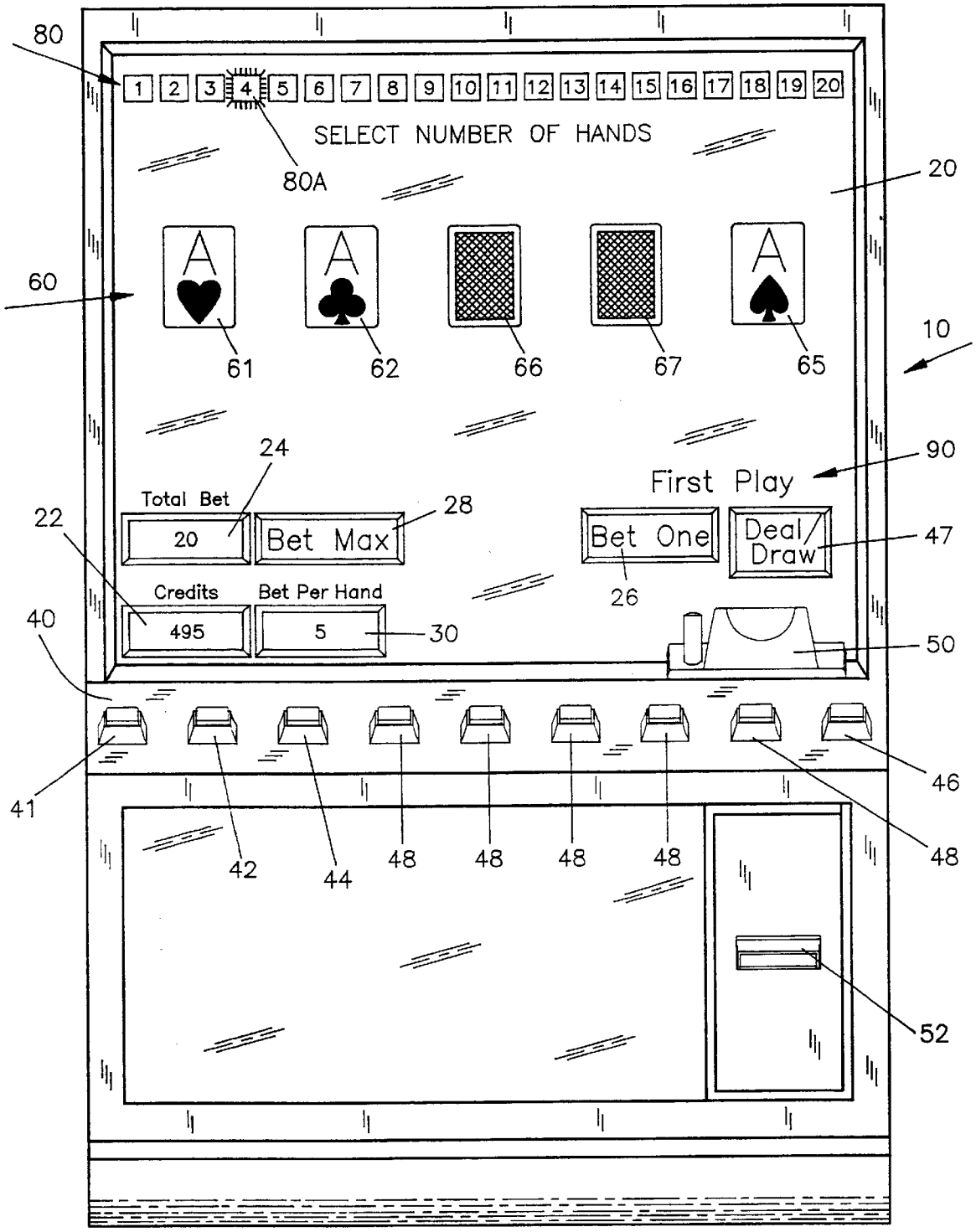
FIG. 2 shows the screen display for Version #A after the player has selected the cards he wishes to hold in the FIRST PLAY of the initial starting hand.

As shown in the example of FIG. 2, the player has held the Ace of Hearts 61, the Ace of Clubs 62, and the Ace of Spades 65. When the player has completed choosing the cards he wishes to hold, the player activates the DRAW 47 button and a replacement card 66 and 67 is dealt for each of the discarded cards 63 and 64.

Figure 3:
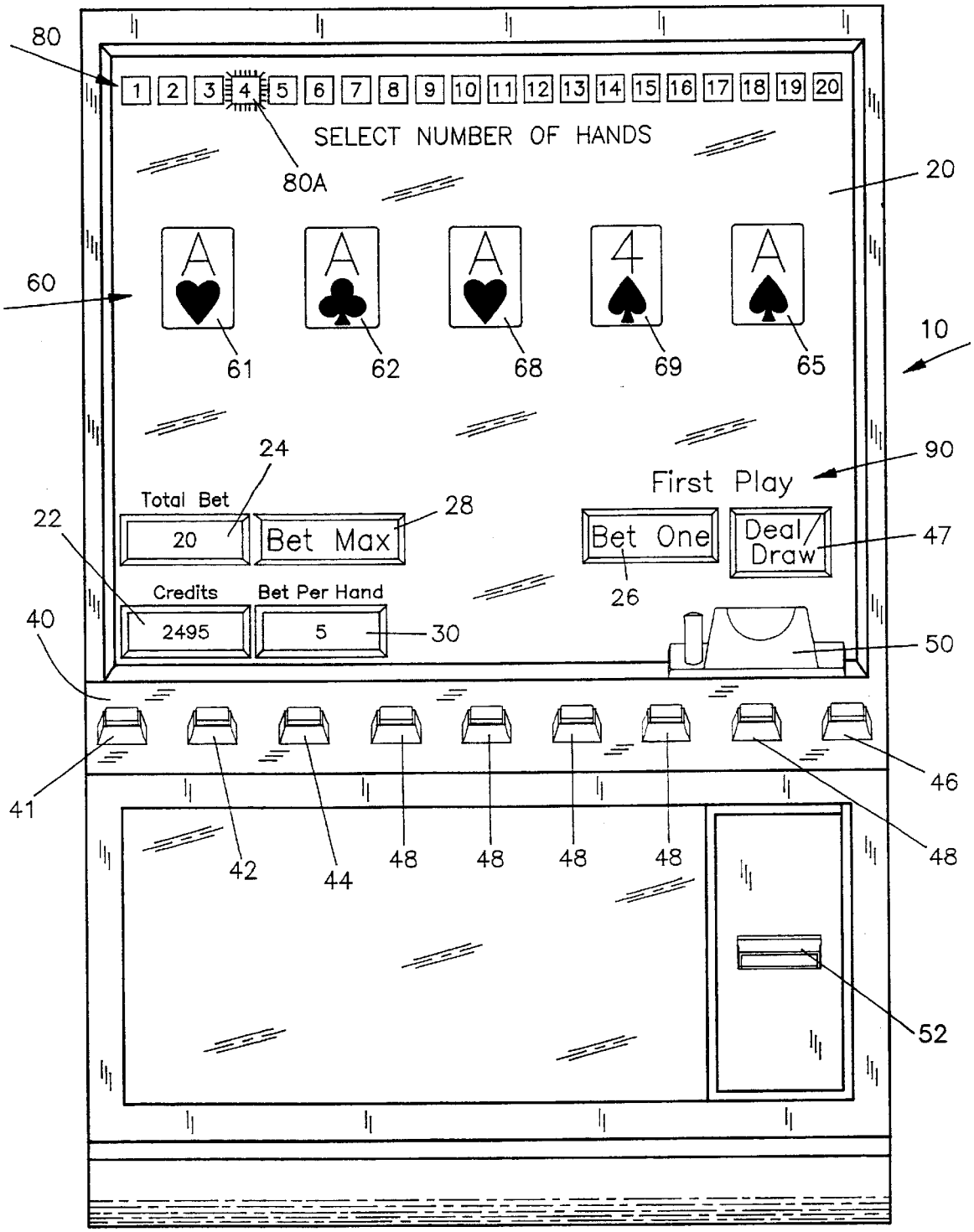
FIG. 3 shows the screen display for Version #A after replacement cards have been dealt resulting in the final five cards for the FIRST PLAY.

As shown in FIG. 3, the player has received the Ace of Hearts 68 and the Four of Spades 69 as the replacement cards and the player has achieved a Four-of-a-Kind with a Kicker.

The amount won the player for a winning hand combination is based on the poker hand ranking achieved by the player and the number of coins, tokens or credits wagered by the player. A pay table is shown to the player in any suitable manner such as the pay table being imprinted on the display glass of the gaming machine 10 or being shown on the video screen display 20. A representative pay table is shown in Table 1:

TABLE 1

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES WITH ANY 2, 3 OR 4 | 400 | 800 | 1200 | 1600 | 2000 |
| FOUR 2'S, 3'S OR 4'S WITH ANY ACE, 2, 3 OR 4 | 160 | 320 | 480 | 640 | 800 |
| FOUR ACES | 160 | 320 | 480 | 640 | 800 |
| FOUR 2'S, 3'S OR 4'S | 80 | 160 | 240 | 320 | 400 |
| FOUR 5'S THRU KINGS | 50 | 100 | 150 | 200 | 250 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |

TABLE 1-continued

| | NUMBER OF COINS BET | | | | |
|---|---|---|---|---|---|
| POKER HAND | 1 | 2 | 3 | 4 | 5 |
| TWO PAIR | 1 | 2 | 3 | 4 | 5 |
| JACKS OR BETTER | 1 | 2 | 3 | 4 | 5 |

The pay table shown in Table 1 is a preferred pay table when the method of play of the present invention is applied to a Double Double Bonus Draw Poker format, but any suitable pay table can be used.

Using the pay table shown in Table 1, the player would win two thousand credits for achieving a Four-of-a-Kind with a Kicker on the first play of the initial starting hand since five credits had been allocated as the wager for the FIRST PLAY. The winning amount of two thousand credits would be accrued on the credit meter 22.

Figure 4:
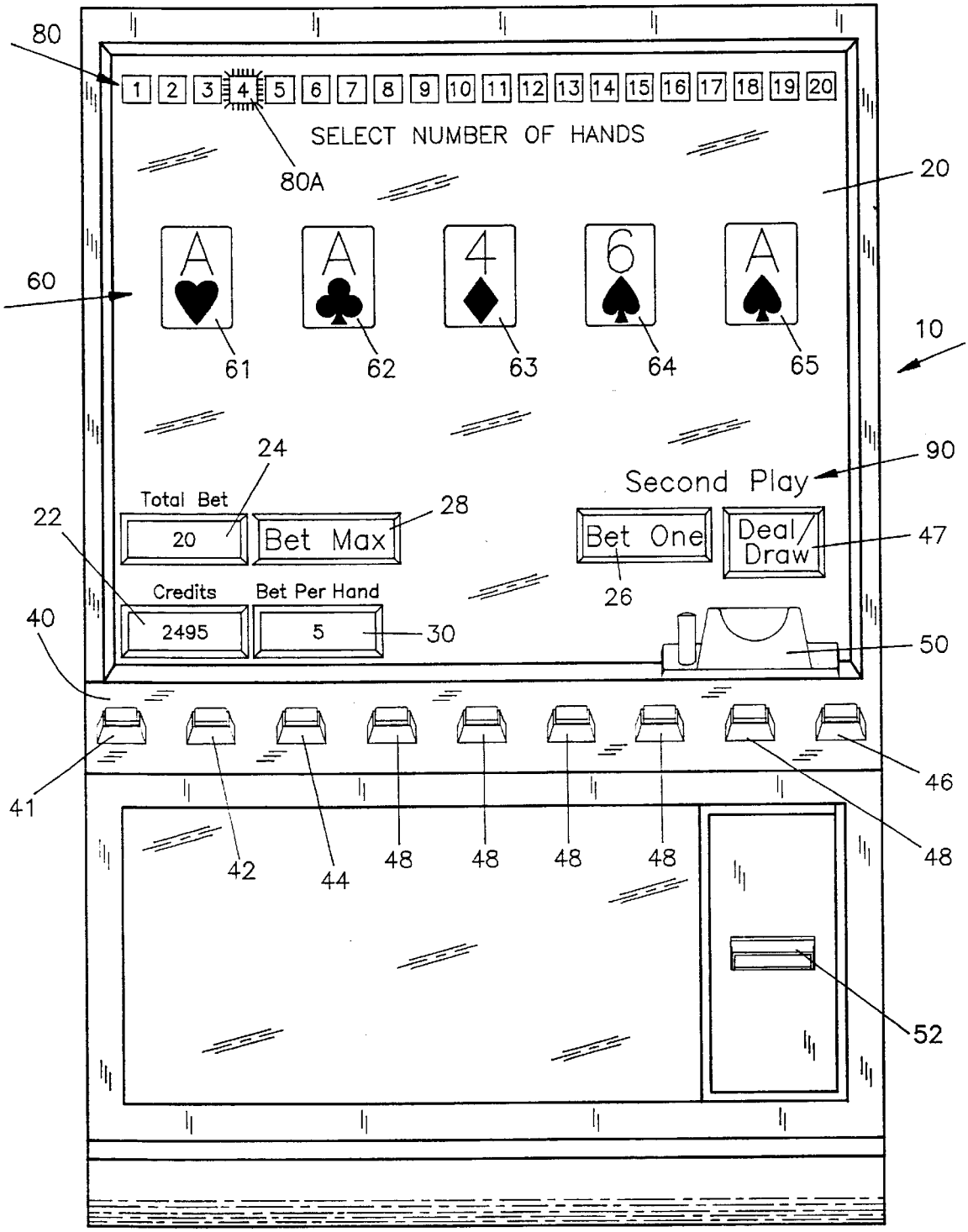
FIG. 4 shows the screen display for Version #A in which the initial five cards are used in the SECOND PLAY of the initial starting hand.

The play of the game now proceeds to SECOND PLAY at which time the SECOND PLAY 91 indicia is now displayed. The original initial five cards are now re-displayed on the video screen, so that the player has the same starting five cards. As shown in FIG. 4, the video screen again displays the Ace of Hearts 61, the Ace of Clubs 62, the Four of Diamonds 63, the Six of Spades 64 and the Ace of Hearts 65. The player then chooses which of the cards the player wishes to hold, if any, and which cards the player wishes to discard. Again the player may hold any of the cards or none of the cards or all of the cards from the initial starting hand and the player may play this SECOND PLAY 91 differently than he played the FIRST PLAY 90 by holding different cards or the player may play the SECOND PLAY 91 in the same manner as the FIRST PLAY 90 by holding the same cards. This gives the player a high degree of flexibility when it comes to playing various initial starting hands.

Figure 5:
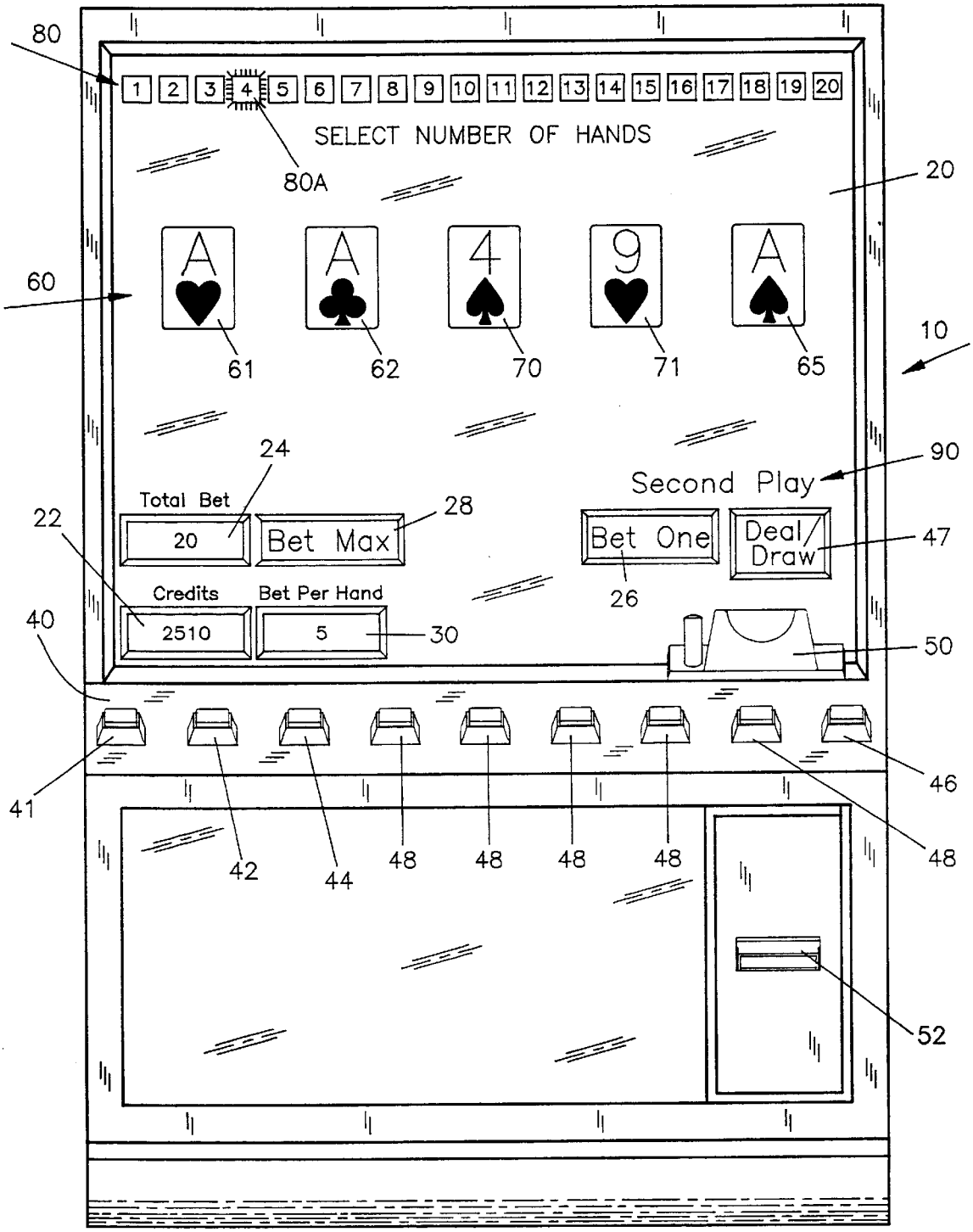
FIG. 5 shows the screen display for Version #A after replacement cards have been dealt resulting in the final five cards for the SECOND PLAY.

Proceeding to FIG. 5, the player has this time again held only the three Aces. When the replacement cards are dealt, the player received a Four of Spades 70 and a Nine of Hearts 71. The final five cards of the SECOND PLAY 91 comprise a Three-of-a-Kind. Based on a five credit wager on the SECOND PLAY 91, the player would win fifteen credits for a Three-of-a-Kind and the winning amount would be accrued on the credit meter 22.

The play of the game now proceeds in the same manner for the THIRD PLAY and the FOURTH PLAY.

On each play of the initial starting hand, the player may hold none, one or more the five cards. The player can play each starting hand any way the player desires. The player can hold the same cards in each hand or the player can hold different cards in each hand or the player can play some of the hands one way and the other of the hands another way. The player has full freedom to play each in any manner that the player desires.

While the example of the method of play described above is shown in conjunction with a Double Double Bonus Poker format, the method of play of the present invention can also be applied to any other variation of draw poker, such as regular Draw Poker, Deuces Wild Poker, Bonus Poker, Double Bonus Poker, Triple Bonus Poker, Joker's Wild Poker and the like. Each of these video poker variations uses various arrangements of poker hand rankings as winning combinations.

In the preferred embodiment of the present invention, the replacement cards are dealt from a depleted deck of forty-seven cards representing the initial fifty-two card deck less the five initial cards. On each play of the initial starting hand, the same depleted deck of forty-seven cards is used so that the player has the same opportunity on each play to achieve the various winning combinations.

Alternatively, it is possible, but less desirable, to continue to deplete the deck each time the replacement cards are dealt. For example, on the FIRST PLAY, the replacement deck would comprise the forty-seven cards remaining after the initial deal of five cards. If the player discarded and replaced two cards during the FIRST PLAY of the initial starting hand, then the replacement deck for the SECOND PLAY would only have forty-five cards available since the replacement cards dealt into the FIRST PLAY would not be available as replacement cards for the SECOND PLAY. And so on, through the number of selected plays made by the player.

Version #B: This version is played similarly to Version #A except that the initial starting hand has only three cards. The player holds none, one, two or all three of the initial cards in an attempt to achieve a three card poker hand. Winning hand combinations are provided for the resulting three card combinations and a suitable pay table is presented to the player. Each starting three card hand is replayed the desired number of times based on the selection made by the player at the beginning of each round.

Other variations may be utilized such as four card poker, six card poker, seven card poker or an even higher number of cards in a poker hand. Winning hand combinations are provided for each type of poker hand and a suitable pay table is presented to the player depending on how many cards will be in the final hand.

In each of the preferred embodiments of the present invention, a standard fifty-two card deck of playing cards is used for each deck. One or more cards may also be designated as wild cards and, alternatively, one or more Jokers may be added to the deck of cards and the Jokers may then be used as wild cards.

In each of the preferred embodiments of the present invention, the amount of the player's wager on each hand would be the same. Alternatively, the player could be allowed to make wagers of different amounts on each hand.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) a player making a total wager to be eligible to play the card game;

b) dealing an initial hand comprising five cards all face up;

c) prior to any further play of the initial hand, the player selecting two plays of the initial hand and allocating the total wager among the two plays selected by the player;

d) the player playing a FIRST PLAY of the initial hand by selecting none, one or more of the face up cards from the first hand as cards to be held;

e) discarding from the starting hand the cards that were not selected to be held and replacing each of those cards with a face up card;

f) determining the poker hand ranking of the resulting cards of the FIRST PLAY;

g) redisplaying the initial starting hand as a SECOND PLAY;

h) the player playing the SECOND PLAY of the initial hand by selecting none, one or more of the face up cards of the redisplayed cards as cards to be held;

i) discarding from the starting hand the cards that were not selected to be held and replacing each of those cards with a face up card;

j) determining the poker hand ranking of the resulting cards of the SECOND PLAY.

2. The method of claim 1 including the steps of:

a) paying the player a preestablished amount based on a pay table and the amount of the allocated wager on the FIRST PLAY if the resulting cards of the FIRST PLAY comprise a predetermined poker hand ranking; and b) paying the player a preestablished amount based on a pay table and the amount of the allocated wager on the SECOND PLAY if the resulting cards of the SECOND PLAY comprise a predetermined poker hand ranking.

3. A method of playing a card game comprising:

a) a player making a total wager to be eligible to play the card game;

b) dealing an initial hand comprising five cards all face up;

c) prior to any further play of the initial hand, the player selecting at least two plays of the initial hand and allocating the total wager among the plays selected by the player;

d) the player playing a FIRST PLAY of the initial hand by selecting none, one or more of the face up cards from the first hand as cards to be held;

e) discarding from the starting hand the cards that were not selected to be held and replacing each of those cards with a face up card;

f) determining the poker hand ranking of the resulting cards of the FIRST PLAY;

g) redisplaying the initial starting hand as a SECOND PLAY;

h) the player playing the SECOND PLAY of the initial hand by selecting none, one or more of the face up cards of the redisplayed cards as cards to be held;

i) discarding from the starting hand the cards that were not selected to be held and replacing each of those cards with a face up card;

j) determining the poker hand ranking of the resulting cards of the SECOND PLAY; and k) repeating steps g), h), i) and j) for the full number of plays selected by the player.

4. The method of claim 3 including paying the player a preestablished amount based on a pay table and the amount of the allocated wager on the each of the PLAYS whenever the resulting cards of a PLAY comprise a predetermined poker hand ranking.

5. A method of playing a card game comprising:

a) a player making a total wager to be eligible to play the card game;

b) dealing an initial hand comprising a predetermined number of cards all face up;

c) prior to any further play of the initial hand, the player selecting two plays of the initial hand and allocating the total wager among the two plays selected by the player;

d) the player playing a FIRST PLAY of the initial hand by selecting none, one or more of the face up cards from the first hand as cards to be held;

e) discarding from the starting hand the cards that were not selected to be held and replacing each of those cards with a face up card;

f) determining the poker hand ranking of the resulting cards of the FIRST PLAY;

g) redisplaying the initial starting hand as a SECOND PLAY;

h) the player playing the SECOND PLAY of the initial hand by selecting none, one or more of the face up cards of the redisplayed cards as cards to be held;

i) discarding from the starting hand the cards that were not selected to be held and replacing each of those cards with a face up card;

j) determining the poker hand ranking of the resulting cards of the SECOND PLAY.

6. The method of claim 5 including the steps of:

a) paying the player a preestablished amount based on a pay table and the amount of the allocated wager on the FIRST PLAY if the resulting cards of the FIRST PLAY comprise a predetermined poker hand ranking; and b) paying the player a preestablished amount based on a pay table and the amount of the allocated wager on the SECOND PLAY if the resulting cards of the SECOND PLAY comprise a predetermined poker hand ranking.

7. The method of claim 5 in which the predetermined number of cards is at least three.

8. A method of playing a card game comprising:

a) a player making a total wager to be eligible to play the card game;

b) dealing an initial hand comprising a predetermined number of cards all face up;

c) prior to any further play of the initial hand, the player selecting at least two plays of the initial hand and allocating the total wager among the plays selected by the player;

d) the player playing a FIRST PLAY of the initial hand by selecting none, one or more of the face up cards from the first hand as cards to be held;

e) discarding from the starting hand the cards that were not selected to be held and replacing each of those cards with a face up card;

f) determining the poker hand ranking of the resulting cards of the FIRST PLAY;

g) redisplaying the initial starting hand as a SECOND PLAY;

h) the player playing the SECOND PLAY of the initial hand by selecting none, one or more of the face up cards of the redisplayed cards as cards to be held;

i) discarding from the starting hand the cards that were not selected to be held and replacing each of those cards with a face up card;

j) determining the poker hand ranking of the resulting cards of the SECOND PLAY; and k) repeating steps g), h), i) and j) for the full number of plays selected by the player.

9. The method of claim 8 including paying the player a preestablished amount based on a pay table and the amount of the allocated wager on the each of the PLAYS whenever the resulting cards of a PLAY comprise a predetermined poker hand ranking.

10. The method of claim 8 in which the predetermined number of cards is at least three.

* * * * *